US005934000A

United States Patent [19]

Hayes, Sr.

[11] Patent Number: 5,934,000

[45] Date of Patent: Aug. 10, 1999

[54] BREECH TO NOZZLE GUN CLEANER, SAFETY DEVICE, AND METHOD

[76] Inventor: Robert H. Hayes, Sr., 12 Forest Glen Rd., Valley Cottage, N.Y. 10989

[21] Appl. No.: 08/903,906

[22] Filed: Jul. 31, 1997

Related U.S. Application Data

[60] Provisional application No. 60/023,096, Aug. 1, 1996.

[51] Int. Cl.[6] ..... F41C 27/08; F41A 29/02; F41A 17/02

[52] U.S. Cl. ..... 42/95; 15/104.2; 42/70.11

[58] Field of Search ..... 15/104.05, 104.001, 15/104.066, 249.1, 249.2, 104.93, 229.6, 88; 42/95

[56] References Cited

U.S. PATENT DOCUMENTS

| | | | |
|---|---|---|---|
| 2,379,962 | 7/1945 | Hoehle | 15/104.2 |
| 2,763,081 | 9/1956 | Huckabee | 42/70.11 |
| 4,195,381 | 4/1980 | Jurich, III | 15/104.2 |
| 4,901,465 | 2/1990 | Hsu | 42/95 |
| 5,233,777 | 8/1993 | Waterman, Jr. et al. | 42/70.11 |

*Primary Examiner*—Michael J. Carone
*Assistant Examiner*—Denise J. Buckley
*Attorney, Agent, or Firm*—W. Patrick Quast, Esq.

[57] ABSTRACT

A gun barrel cleaner is described for cleaning the bore of a pistol, rifle, or shotgun without danger of contaminating the breech area of the firearm. A cleaning rod is inserted from the nozzle of the gun extending into the breech area. Various structures are described for pivotal quick connection of interchangeable cleaning articles, such as brushes and oil swabs, to the end of the cleaning rod within the breech area. The cleaning article is pivoted into the breech area of the gun, and the rod pulled through the bore of the gun via the nozzle of the gun, preventing debris and/or oil contamination of the breech area of the gun. The procedure is then repeated as necessary utilizing different interchangeable cleaning articles as required. When clean, the cleaning article is replaced with a locking pin-locking tube combination secured by a padlock at the breech area of the gun with the cleaning rod in place within the barrel of the gun, visibly rendering accidental loading and discharge of the weapon impossible.

9 Claims, 4 Drawing Sheets

BREECH TO NOZZLE GUN CLEANER, SAFETY DEVICE, AND METHOD

This application claims the benefit of U.S. Provisional Application No. 60/023,096, filed Aug. 1, 1996.

BACKGROUND

This invention relates to gun cleaning and safety devices for pistols, rifles, or shotguns, and in particular for cleaning gun barrels from the breech of the gun to the nozzle of the barrel, and securing a gun visibly at the breech area of the gun.

The barrel of a firearm, whether a hand gun, rifle, or shotgun, must be kept as clean as possible to ensure safe firing of the device and to facilitate accuracy of the round as it travels through the barrel to be discharged. The explosion of the charge to propel the round deposits residue on the interior of the barrel proximate the trigger, breech, and ejection port assembly which, if permitted to remain, can deteriorate and impair the ability of the firearm to function safely and accurately. The action and assemblies of automatic and semi-automatic firearms are particularly vulnerable to foreign matter which can cause jamming and misfires.

This invention also addresses the problem of securing a firearm against accidental discharge, particularly in the case of a firearm that may be kept in a private home with children having potential access to the firearm.

Numerous devices for cleaning and securing firearms have been proposed, as is evident from the following examples. Malesky, in U.S. Pat. No. 2,544,847, discloses a flexible rifle and shotgun cleaner shaft. In this device a flexible shaft 5 has a brush 15 swivelly connected at one end and a slotted link adapter 20 swivelly connected at its other end. The device can be used for breech to nozzle rifle cleaning operations so as not to contaminate the mechanism of the firearm or the cartridge chamber. Schultra in U.S. Pat. No. 3,708,820 discloses a gun cleaner and protecting device. The device consists of a sock or sleeve 10 two inches or more longer than the rifle barrel in which it is to be used. The device may be used to clean a firearm barrel from breech to nozzle, and then is left in the barrel so as to prevent accidental discharge of the weapon. Ingalls, in U.S. Pat. No. 3,317,957, discloses a flexible steel cable 16 having an enlarged head 21 at one end and means for securing a padlock 26 at the nozzle end of a firearm so as to prevent accidental use of the gun. Di Prospero, in U.S. Pat. No. 3, 813, 802 discloses a gun cleaning kit and safety device in which a cleaning rod 13 extends from the breech of a gun to the nozzle, being secured to the barrel by a sleeve 10 slidably attached to the gun sight 17. Badoni, in U.S. Pat. No. 4,896,447 teaches a safety device 10 for insertion into the receiver cavity of a semi-automatic firearm while at the same time preventing dirt and debris from contaminating the breech area of a gun during cleaning procedures.

While the above described devices provide useful tools for gun cleaning and safety techniques, they do not envision the precise, rapid, and economical operation of the device and method of the present invention.

It is therefore a primary object of the invention to provide a gun barrel cleaner for rapid and efficient cleaning of pistols, rifles, and shotguns.

An additional object of the invention is to provide for rapid and efficient cleaning of a gun barrel from the breech area of the gun to the nozzle of the gun without danger of contamination of the breech area of the gun.

A further object is to provide for quick connection and disconnection of various gun cleaning articles to the gun cleaning rod of the invention.

Still another object of the invention is to provide a uniquely economical and rapid quick connect-disconnect mechanism on the gun cleaning rod and gun cleaning articles for attachment to the gun cleaning rod.

A further object of the invention is to provide a combination "breech to nozzle" gun barrel cleaner and safety device for the firearm.

SUMMARY OF THE INVENTION

These and other objects are obtained with the breech to nozzle gun cleaner and safety device of the invention.

As noted above a clean gun barrel is essential for safe and accurate operation of virtually any kind of firearm. Typically, the barrel of a gun is cleaned by running a rod with an attached cleaning article, such as a brush, a swab, or a slotted cleaning head with a cloth patch insert, from the nozzle end of the barrel to the breech area of the gun. While this appears to properly clean and oil the gun barrel the result is often debris and/or oil contamination of the breech area of the firearm being cleaned.

To prevent contamination of the breech area of a gun during cleaning procedures, an ideal method is to begin at the breech area of the gun, and then pull the cleaning or oiling implement through the gun barrel, exiting at the nozzle of the barrel. A rigid or at least semi-rigid rod is well suited for attachment of various cleaning articles to the rod, such as brushes and oil swabs, in order to perform thorough barrel cleaning. However, the rigid nature of the rod would obviously preclude breech to nozzle cleaning procedures. Alternatively, flexible cables with cleaning implements being threadibly attached at one end or another can be cumbersome and time consuming in use.

It occurred that sliding a rigid rod from the nozzle of a gun barrel to the breech area, and then having a top portion of this rod within the breech area capable of pivoting upwards at a substantially right angle to the plane of the rod within the barrel, now provides a method for quick connection of a cleaning implement to the end of the rod. The cleaning article can then be flipped back into the breech area providing an extension of the rod in the same plane as the rod within the barrel. The rod can then be pulled towards the nozzle end of the barrel, moving the cleaning element through the bore of the barrel without danger of contamination of the breech area of the gun. The cleaning article is then removed from the rod, and the procedure repeated as necessary.

In one version of the invention a hollow tube is hingeably affixed to the end of the rod. When the rod is inserted into the barrel of a gun with the hinged end appearing in the breech area, the hinged end is simply flipped up and a cleaning article attached. The cleaning article can have, for example, a retractable ball along its length for insertion into the hollow tube rod extension with the ball snapping out into a matching hole along the length of the hollow tube rod extension in order to secure the cleaning article to the rod.

In a preferred embodiment of the invention the end of the rod to be exposed in the breech area has slots cut into it to accept an end extension of a cleaning article. For example, in the case of a solid rod, viewing the rod from its top surface, a first longitudinal slot is made from the end of the rod to approximately a depth of ¾" along the length of the rod. Viewing this end of the rod from its side, a second slit is made, confluent with this first slot and extending through the rod longitudinally beginning near but not at the end of the first longitudinal slot and extending approximately ½" along the longitudinal side of the rod back towards the end of the rod. Viewing the rod again from its top surface a third slot is made laterally across the width of the rod at a distance of approximately ½" from the end of the rod, this third slot being confluent with both the first and second slots, forming a substantially L shaped opening with the second slot at this end of the rod as viewed from it side.

This simple, inexpensive slotted arrangement now provides for a quick, precise, and reliable method for connecting and disconnecting cleaning articles. In addition this same arrangement can be employed for connecting and disconnecting a padlock at the breech area of a firearm to secure the weapon against accidental discharge.

For example, a cleaning article such as a brush, oil swab, or slotted head with attached cloth patch has an extension at one end with a portion at the end of the extension which is narrower than the width of the first slot in the rod. A pin runs laterally through this narrow end of the extension. The actual connection of the cleaning article to the rod is made by simply inserting the cleaning article pin into the third slot at the end of the rod, then sliding the pin forward in the second slot towards the end of the rod, a stop for the pin being formed by the end of the second slot which is a spaced distance away from the physical end of the rod. The cleaning article is now free to pivot downwards into the breech area of the firearm. Withdrawing the rod from the barrel from breech to muzzle now cleans and/or oils the barrel bore. After removing the rod from the barrel the cleaning article is quickly disconnected from the rod by simply flipping it up and moving the pin forward so as to match the entering third slot whereby the article is simply pulled up separating the article form the rod. The procedure is then simply repeated as often as necessary in order to clean the bore of the barrel making use of various types of cleaning articles as previously mentioned.

This same mechanism can also be used to secure a firearm against accidental discharge. For example, a locking pin having a slot connecting pin as described above for connection to the rod can be secured to a rod at the open breech area. The locking pin has a hole placed along its length for securing the shackle of a padlock. Placing a locking tube over the locking pin and then securing a padlock to the locking pin provides a simple and effective means for securing a firearm for storage purposes as will be more fully described below. This locking arrangement provides an obvious visual indication that the weapon is secured, and since the lock is in the breech area a cartridge cannot be placed in the gun, making it completely child proof.

In an alternative structure for a quick connect-disconnect for cleaning articles or a locking shaft to the cleaning rod, the top end portion of the rod exposed within the breech of the gun can simply have an access slot across its width connecting to a longitudinal slot through the rod extending almost to the physical end of the rod. Cleaning articles or a locking shaft having a rectangularly shaped rod connector at their bases can simply connect to this entrance slot in the rod and then pivot forward into the breech area of the gun.

The rod portion of the invention has a handle suitable for convenient manipulation. The rod itself is preferably rigid or at least semi-rigid, and can be fabricated in steel or plastic, such as nylon. For portable convenience, the rod can be in two or more sections, forming a complete rod when required by any convenient coupling means, as, for example, threading the ends together to form a complete rod. The extensions and pins described for the end portion of cleaning articles or locking shafts are preferably metal, such as steel, or rigid plastics, such as phenolics or nylon.

DETAILED DESCRIPTION OF THE PREFERRED EMBODIMENT

Figure 1:
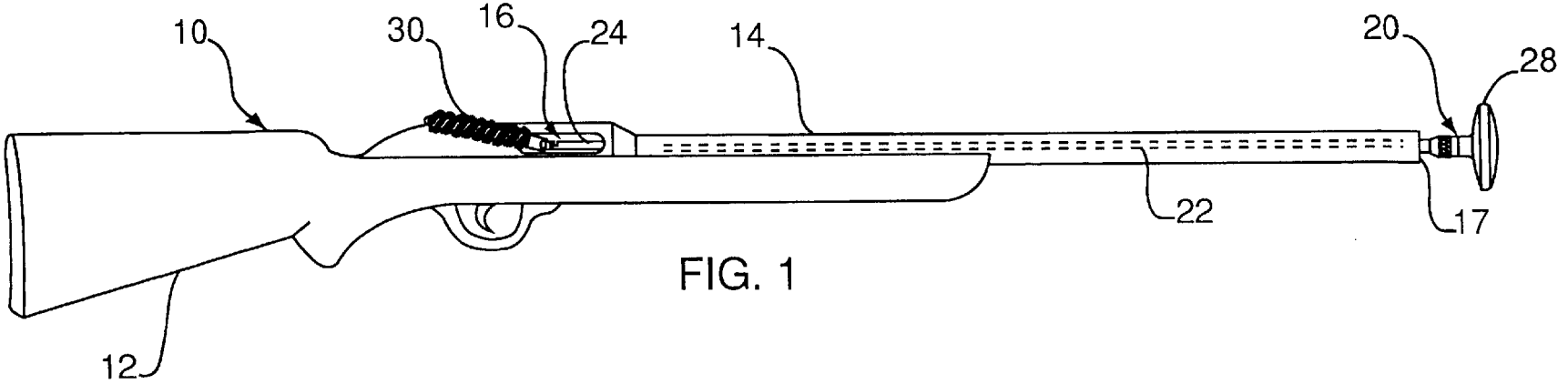
FIG. 1 is a perspective view of one version of the breech to nozzle gun cleaner of the invention.
Figure 2:
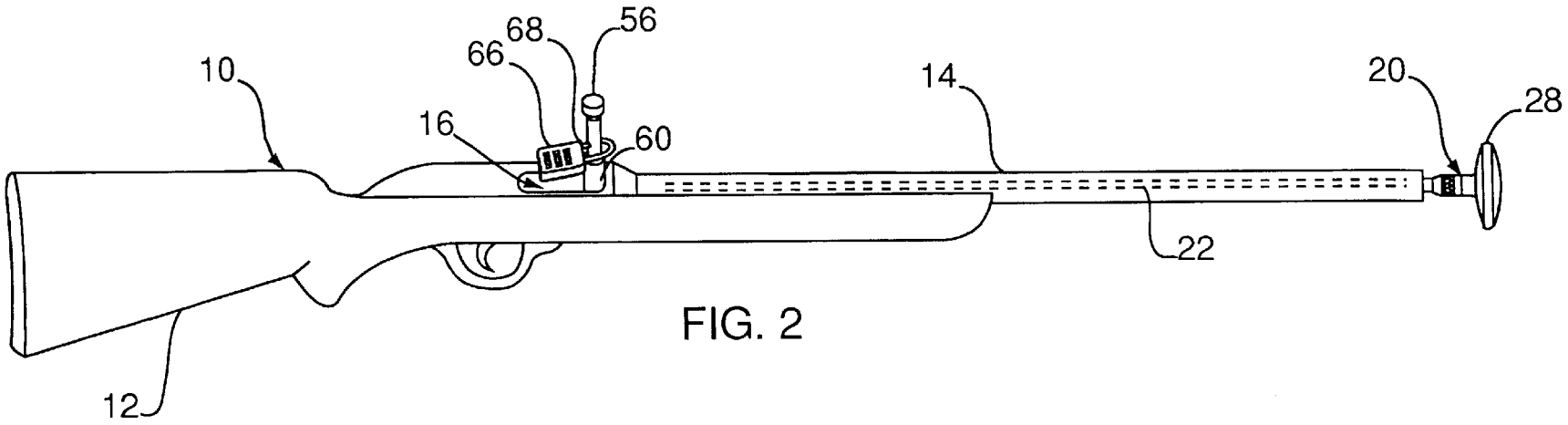
FIG. 2 is a perspective view of one version of the safety device of the invention.

Referring now to the drawings, in FIG. 1 a typical firearm 10, such as a rifle or shotgun, is shown being cleaned by a version of the gun cleaner 20 of the invention. The firearm 10 has a stock 12, a barrel 14, and a breech area 16 for loading cartridges to be fired. The gun cleaner 20 is shown comprised of a handle 28, a rod 22 within the barrel 14 of the gun 10, with a top portion 24 of the rod 22 extending into the breech area 16 of the firearm. A brush cleaning article 30 is shown pivotally attached to the top portion 24 of the cleaning rod 22.

Figure 3:
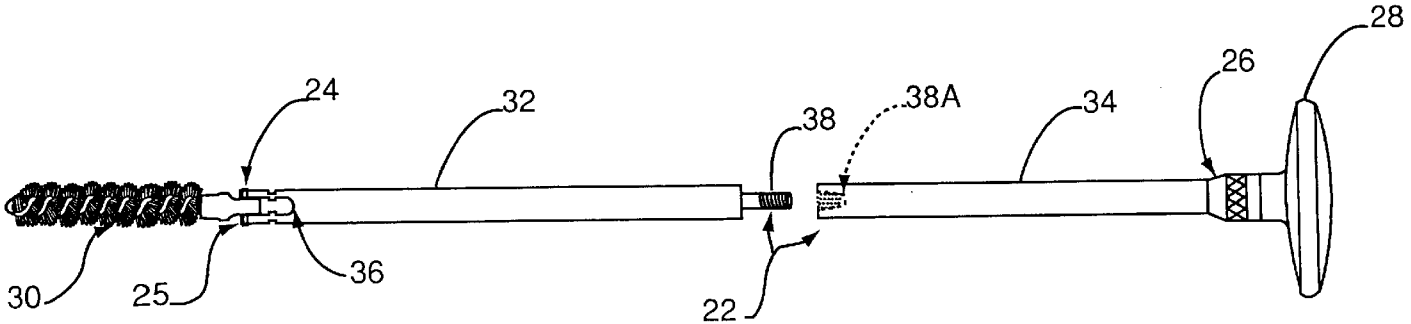
FIG. 3 is a top plan, partially cutaway and partially exploded view of one version of the breech to nozzle gun cleaner of the invention showing a brush attachment for the gun cleaner.

FIGS. 3, and 4A–4F give details of a preferred embodiment of the gun cleaner of the invention. In FIG. 3 the rod 22 is shown in a two section construction, having a top portion 24 of the rod now being at the top end of the first section 32 of the rod, the first section having a threaded male member 38 at its base end for connection to a female threaded portion 38A of a second section of the rod 34. A handle 28 is affixed to the base end 26 of this second section.

The rod 22 can obviously be subdivided into additional sections as might be required for storage or transportation requirements. Other methods for connecting sections of the rod together might include a ball in socket connection, friction fit, bayonet connection, and so on. A brush cleaning article 30 is shown fully attached at the top end 25 of the top portion 24 of the first section 32 of the rod.

Figure 4A:
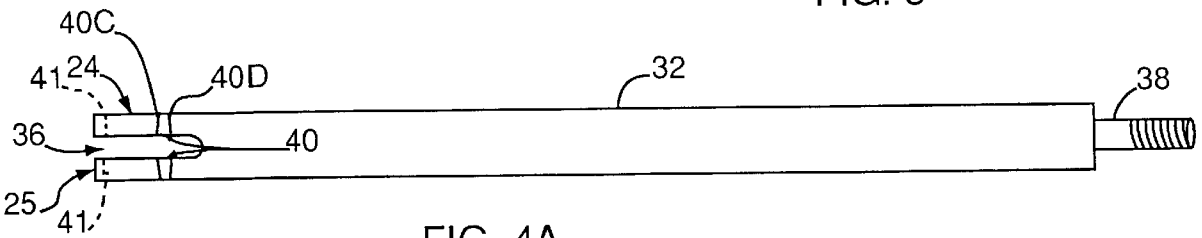
FIG. 4A is a top plan view of a version of a first portion of the cleaning rod of the invention.
Figure 4B:
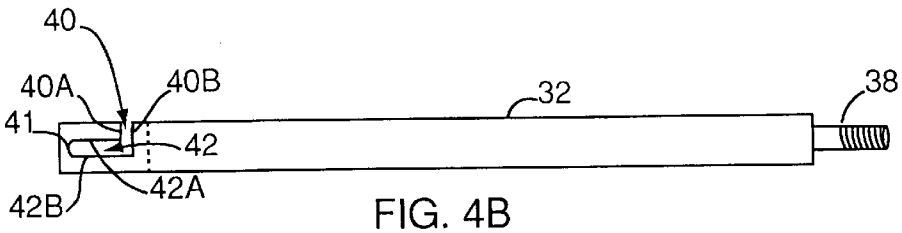
FIG. 4B is a side view of a version of a first portion of the cleaning rod of the invention.
Figure 4C:
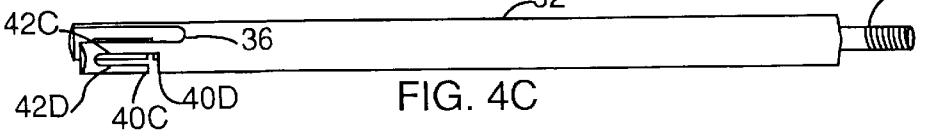
FIG. 4C is a bottom plan-perspective view of a version of a first portion of the cleaning rod of the invention, with the rod rotated somewhat off of the exact, 180°, bottom plan view of FIG. 4A in order to better illustrate the relationship of slot 36 and slot 42.

FIGS. 4A–4F show in detail a version of the structure for rapid and efficient connection and disconnection of the various attachments to the cleaning rod. FIGS. 4A–4C depict the confluent slots providing a unique, no moving parts, fast, and simple method for connecting the various articles. A first slot 36 begins at the top end 25 of the top portion 24 of the rod, extending longitudinally along the length of the rod for approximately ¾". A second slot 42, positioned at a right angle to the first slot 36 begins a spaced distance away from the top end 25 of the top portion 24 of the rod, extending longitudinally along the left and right sides of the rod for approximately ½". A third slot 40 is laterally positioned on the rod immediately above and confluent with the second slot 42, this third slot forming a notched entrance, via left side walls 40A, 40B, and right side walls 40C, 40D, to both the first and second slots. When viewed from the side, slot 42 forms a left side guideway 42A, 42B with stop 41 near the top end 25 of the top portion of the rod; and also forms a right side guideway 42C, 42D with stop 41.

Figure 4D:
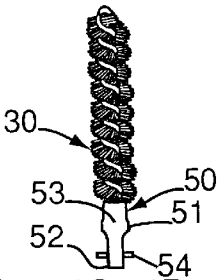
FIG. 4D is one version of a brush cleaning article for attachment to the cleaning rod of the invention.
Figure 4E:
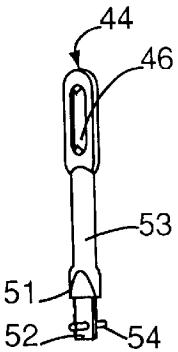
FIG. 4E is one version of a slotted head cleaning article for attachment to the cleaning rod of the invention.
Figure 4F:
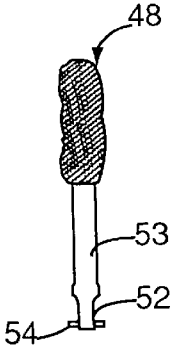
FIG. 4F is one version of an oil swab cleaning article for attachment to the cleaning rod of the invention.

The cleaning articles depicted in FIGS. 4D, 4E, and 4F illustrate a brush cleaning article 30, a slotted head cleaning article 44 (showing a slot 46 for securing a cloth patch [not shown]), and an oil swab cleaning article 48. All are equipped with an extension 50 at their base for cooperating with the slotted top portion 24 of the first section 32 of the cleaning rod. A narrow portion 52 of the extension 50 is dimensioned so as to easily slip into the first slot 36. A pin 54 is affixed at the end of this narrow portion 52, extending laterally to the left and right of this narrow portion. A shoulder 51 is formed between a wider portion 53 of the extension 50 and narrow portion 52.

To operate the gun cleaner 20 of the invention, the handle 28 is grasped by an operator and the attached rod 22, without cleaning article attachment, is inserted into the nozzle 17 of the firearm, and then is moved manually along the barrel 14 of the gun until the top portion 24 of the rod 22 is accessible within the breech area 16 of the firearm. A suitable cleaning article, such as brush 30, is selected, and the pin 54 at the base of the brush is inserted into the notch formed by the walls 40A–40D of the third slot. With the pin 54 now sliding along in left and right guideways 42A–42D, the narrow portion 52 on the brush base is moved forward until the pin contacts the stop 41 at the end of the left and right guideway formed by the second slot 42. The brush is now pivoted downward so as to form an axial extension of rod 22. The operator now withdraws the rod from the breech area 16 to the nozzle 17 of the firearm with no danger of contaminating the breech area during the barrel cleaning procedure. The operator is free to manipulate the rod in a reciprocal manner within the barrel if desired since the pin 54 permits vigorous pulling of the rod; and the shoulder 51 between the cleaning article extension 50 and narrow portion limits the motion of the narrow section 52 within the first slot, permitting vigorous pushing motions as well by the operator. When the rod 22 and brush 30 are fully withdrawn from the barrel 14, the brush is quickly removed via the notches in the third slot 40, the rod 22 is then reinserted into the barrel, and the procedure repeated as necessary, including interchanging various cleaning or lubricating articles on the rod, until the barrel is satisfactorily cleaned and oiled.

Figure 4H:
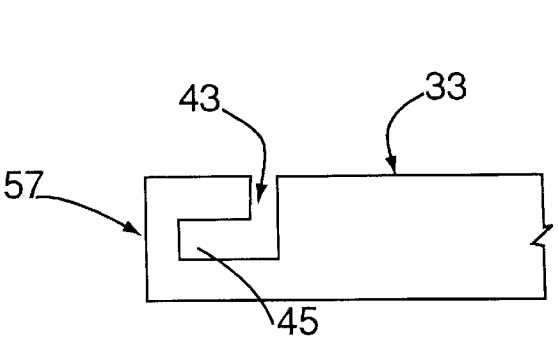
FIG. 4H is a side view of another version of the first section of the cleaning rod of the invention.
Figure 4G:
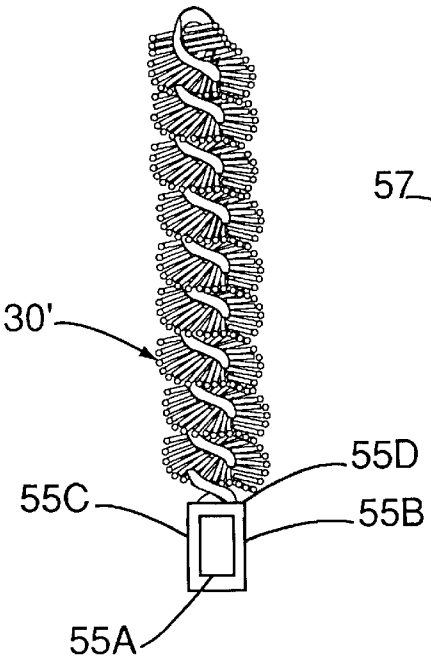
FIG. 4G is another version of a brush cleaning article for attachment to the cleaning rod of the invention.
Figure 4I:
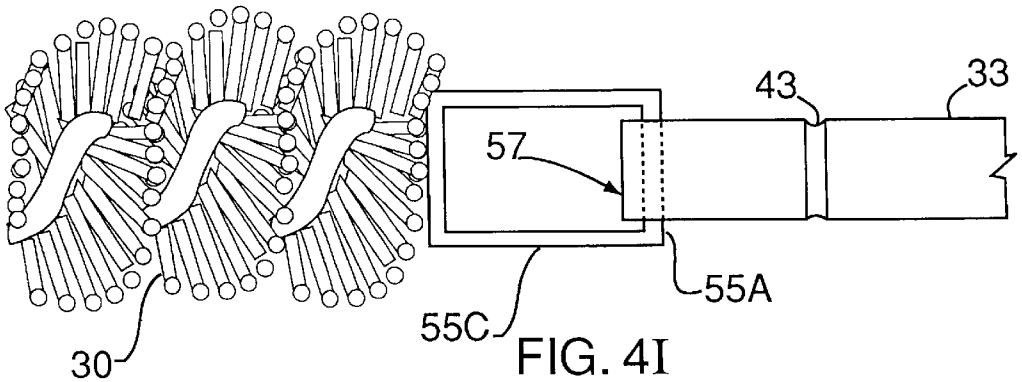
FIG. 4I is a top plan view of the brush of FIG. 4G as being connected to the first section of the rod of the invention depicted in FIG. 4H.

FIGS. 4G, 4H, and 4I illustrate an alternative embodiment of a means for quick connection and disconnection of attachments to the cleaning rod of the invention similar to the structure described above. In this case a simple slot 45 (similar to second slot 42) beginning near the top end 57 of the top portion 33 of the first section of the cleaning rod extends longitudinally approximately ½" back along the length of the rod. A confluent laterally positioned slot 43 positioned along the width of the rod top side provides a notched entranceway into slot 45. Attachments to the rod are then made by a rectangularly shaped extension at the base of each attachment, with the base arm 55D of the rectangular shape being affixed to the base of the attachment (e.g. FIG. 4G, brush 30'), the rectangularly shaped extension having a left side 55C, and a right side 55B, and a top arm 55A. Attachments to the rod are simply made by slipping the top arm 55A into slot 43, then moving the top arm 55A forward in the longitudinal slot 45, and then pivoting the attachment downwards into the breech area 16 of the gun as described above.

Figure 5B:
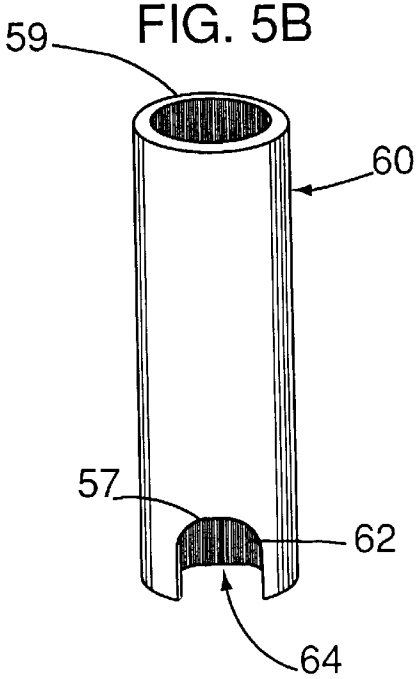
FIG. 5B is a side elevational view of one version of a locking tube for the locking shaft depicted in FIG. 5A.
Figure 6:
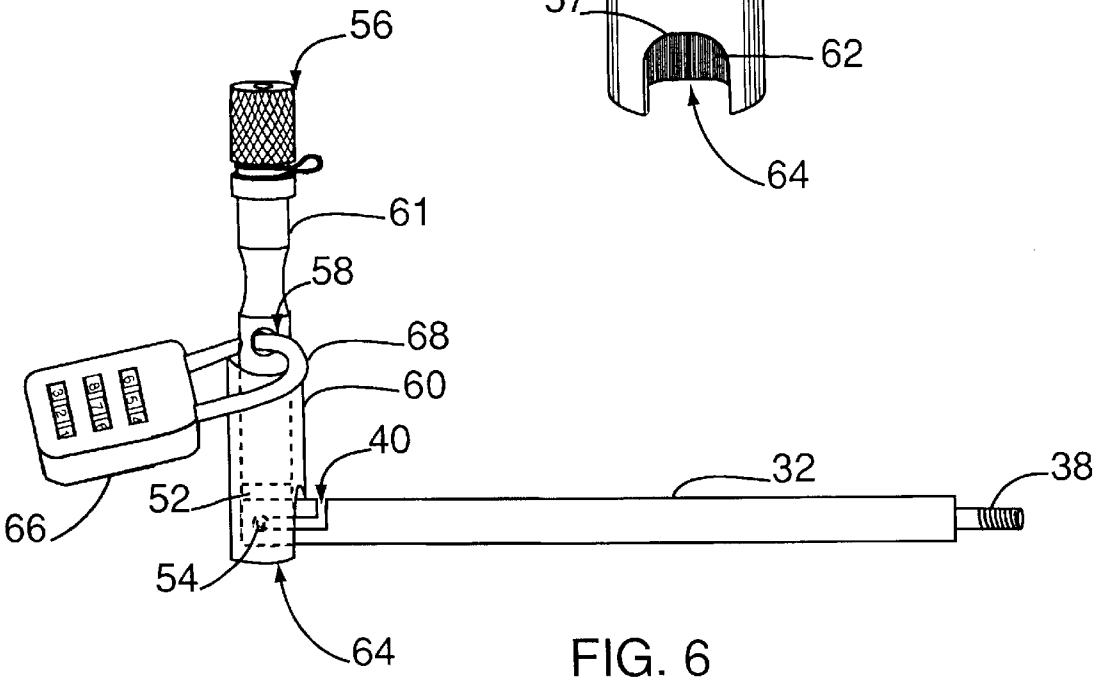
FIG. 6 is a top plan view of one version of the combination of the safety device and first portion of the cleaning rod of the invention.
Figure 5A:
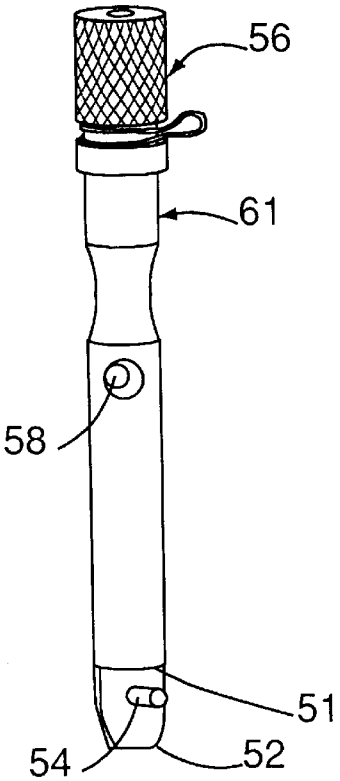
FIG. 5A is a side elevational view of one version of a locking shaft of the invention.

FIGS. 2, 5A, 5B, and 6 illustrate a safety device for firearms making use of the same cleaning rod assemblies as described above, and the same connecting and disconnecting means described and illustrated for the various cleaning articles. FIGS. 5A, 5B, and 6 show a locking pin 56 including a shaft 61 having a hole 58 laterally positioned along the length of the locking shaft for accepting the shackle 68 on a padlock 66. The locking shaft has the same narrow portion 52 and pin 54 at its base as previously described for connecting and disconnecting the various cleaning attachments for the cleaning rod. (The substantially rectangularly shaped connector 55A–55D shown in FIGS. 4G and 4I can also be used as the means for connecting and disconnecting the locking shaft 56 to the rod 22.) As best seen in FIG. 6, a hollow locking tube 60 slides over the locking shaft via 61 its opening at its top 59, and the base of the locking shaft is then connected to the top portion of the cleaning rod as previously described. The oblong slot 62 permits movement of the lock tube 60 towards an enveloping position over the rod 22, which encloses the connection between the top portion of the rod and the pin 54. The oblong slot 62 allows positioning of the apex 57 of the opening, flush to the immediately adjacent surface of the top portion of the rod. At this point, the top 59, of the locking tube just clears the hole 58. With the locking shaft in the breech area of the firearm, in this vertical position relative to the rod within the barrel of the gun, the shackle 68 can now be inserted into the hole 58 in the locking shaft and the padlock secured. The tube 60, locked in a relatively fixed position, again, envelopes the connection between the top portion of the rod, the pin 54 and the slot 40, so that the locking pin 56 cannot be removed. The result is a firearm that is safely and visually secured against accidental discharge. With the breech area 16 serving as the container for the locking mechanism, placing a cartridge accidentally into the breech area of the gun is rendered impossible. Further, in this position the gun action can be closed on the locking tube to prevent damage to the gun. The locking tube is preferably fabricated in a rigid material, such as LEXAN® (a registered trademark of General Electric).

While preferred embodiments for the method for connecting and disconnecting various attachments to the cleaning rod of the invention have been described and illustrated above, other connecting and disconnecting means can be employed within the scope of this disclosure. For example, the aformentioned hinge and retractable ball method can be used, or a ball and socket arrangement, or threaded connections, and so on.

Thus it can be seen that the present invention adds a new convenience in firearm care. The cleaning device of the invention provides an economical and easily operated device for thorough gun cleaning procedures using multiple cleaning articles without any danger of contaminating the breech area of the firearm. The device can be employed in the field, providing efficient barrel cleaning even under adverse conditions of mud or snow contamination of a gun barrel. The gun cleaner of the invention can be provided in a compact kit form for ease in transportation. In addition, a quick-lock coupling-decoupling mechanism is described for rendering a weapon 100% child proof if storage is required in a private home where access to the gun by children is a possibility.

Whereas versions of the present invention have been shown and described in detail, various modifications and improvements thereon will become readily apparent to those skilled in the art. Accordingly, the spirit and scope of the present invention is to be limited only by the following claims.

What is claimed is:

1. A gun barrel cleaner for cleaning the bore of a gun barrel from a breech area of a gun to the nozzle of said barrel, comprising:

(a) a rod, said rod being smaller in diameter than the diameter of said bore, said rod extending a spaced distance beyond the length of said bore of said barrel;

(b) at least one cleaning article for cleaning said bore of said barrel, said cleaning article having attachment means for quick connection and disconnection to said rod;

(c) said rod having a top portion at one end, and a base portion at its other end, said top portion extending into said breech area of said gun when said rod is positioned within said bore of said barrel; and (d) said top portion of said rod having cooperating means for quick connection and disconnection thereto of said attachment of said cleaning article, said cooperating means for quick connection and disconnection being positioned at an end portion of said top portion of said rod extending into said breech area of said gun, said cooperating means forming an integral part of said rod, whereby said cooperating means maintains axial alignment with said rod when said top end is moved through said gun barrel, such that said cooperating means will not score the bore of said barrel, so that when said rod is positioned within said bore of said barrel of said gun with said top portion of said rod extending within said breech area of said gun, and with an end portion of said base portion of said rod extending a spaced distance beyond said nozzle of said barrel, and with said breech area being openly accessible for the placement therein of a cartridge for said gun, said cleaning article can be quickly connected to said end portion of said top portion of said gun, through the cooperative interaction of said attachment means and said cooperating means, said end portion of said base portion of said rod can then be grasped by a hand of an operator and said rod can be withdrawn from said barrel thereby cleaning said bore of said barrel, said cleaning article then being quickly disconnected from said top portion of said rod by disengaging said attachment means from said cooperating means, said rod then being repositioned within said bore of said barrel, and the attachment means of a cleaning article selected by the operator quickly reconnectable again to said cooperating means of said end portion of said top portion of said rod, if required, and so on, until said bore is clean as determined by said operator.

2. The gun barrel cleaner according to claim 1 wherein said attachment and cooperating means for quick connection and disconnection of said cleaning article and said rod comprises means for pivotally connecting said cleaning article to said rod while said article is in a non-axially aligned position in relation to the longitudinal axis of said rod within said barrel when said quick connection is made, said attachment and cooperating means for quick connection and disconnection permitting said article to be pivoted downwards into said breech area of said gun, wherein said article forms a substantially axial extension of said rod within said barrel.

3. The gun barrel cleaner according to claim 2 wherein said pivoting means of said rod comprises a longitudinal first slot along said length of said rod beginning adjacent said end portion of said top portion of said rod, said longitudinal slot cooperating with a second slot positioned across the width of said rod confluent with said longitudinal first slot, said cleaning article pivoting means comprising means for quick connection to said first and second slots within said rod so that said cleaning article can be pivotally positioned by said operator to form a substantially axial extension of said rod within said breech area of said barrel of said gun.

4. The gun barrel cleaner according to claim 2 wherein said pivoting means of said rod comprises a first slot extending transverse across the width of said rod, said first slot extending down into the interior of said rod from the surface of the rod and thereat cooperating with a second slot positioned across the width of said rod confluent with said first slot, said cleaning article pivoting means comprising means for quick connection to said first and second slots within said rod, comprises a substantially rectangularly shaped extension, said rectangularly shaped extension having a substantially rectangularly shaped aperture therethrough, a top arm of said rectangularly shaped extension being affixed to a base portion of said article, a bottom arm of said rectangularly shaped extension being dimensioned so as to slip into said first slot with the left and right sides of said rectangular shape being positioned on an outer surface of said rod said bottom arm of said rectangularly shaped extension then being moved by said operator forward of said first slot and within said confluent second slot so that when said operator positions said bottom arm of said rectangularly shaped extension at a forward end of said second slot said cleaning article is pivotable on said bottom arm of said rectangularly shaped extension so that said cleaning article can be positioned by said operator to form a substantially axial extension of said rod within said breech area of said gun.

5. The gun barrel cleaner according to claim 1 wherein a handle is affixed to said base portion of said rod so that said operator can conveniently manipulate said rod.

6. The gun barrel cleaner according to claim 1 wherein said rod is in at least two sections, said sections of said rod having means for quick connection of one section to another section in order to form a complete rod.

7. The gun barrel cleaner according to claim 1, further comprising a plurality of interchangeable cleaning articles for use in various types of cleaning procedures.

8. The gun barrel cleaner of claim 1 in combination with a safety device, wherein said safety device comprises a locking pin including a shaft and a locking tube, said locking pin being used in place of said cleaning article, said locking tube being a hollow tube dimensioned to slip over said shaft, said locking tube having an aperture at its base for admitting said end portion of said top portion of said rod, said locking pin having attachment means for pivotably quick connecting said shaft to said cooperating means of said rod; and, means for securing said locking tube in a fixed position on said shaft, so that when the connection of said shaft to said rod is made and when said locking tube is slipped over said shaft so as to enclose said end portion of said top portion of said rod and said means for pivotably quick connecting said shaft to said rod, and when said means for securing said locking tube in said fixed position is applied, said safety device is prevented from removal without undoing said means for securing, whereby said gun is prevented from being accidentally discharged.

9. A method for securing a firearm against accidental discharge, comprising the steps of:

(a) opening the breech area of a gun;

(b) inserting a rod extending from a nozzle of a barrel of said gun into said breech area of said gun;

(c) sliding a locking tube over a shaft portion of a locking pin;

(d) pivotally connecting said shaft of said locking pin to an end of said rod extending into said breech area of said gun, said shaft non-axially aligned with the longitudinal axis of said rod during said step of pivotally connecting;

(e) sliding said locking tube to a first position over said shaft, and the pivotal connecting point between said shaft and said end of said rod, said locking tube having an aperture at its base for admitting said pivotal connecting point within said locking tube; and, (f) securing said locking tube in said first position, thereby preventing unintended repositioning of said locking tube from said first position and thus preventing accidental discharge of said firearm.

* * * * *

UNITED STATES PATENT AND TRADEMARK OFFICE

CERTIFICATE OF CORRECTION

PATENT NO : 5,934,000

DATED : August 10, 1999

INVENTOR(S): Robert H. Hayes, Sr., Valley Cottage, New York

It is certified that error appears in the above-identified patent and that said Letters Patent is hereby corrected as shown below:

IN THE CLAIMS: At Column 7, line 36, add the word --means-- after the word "attachment".

At Column 7, line 53, delete the " , " after the word "gun".

At Column 7, line 64, change the word "of" to --at--.

At Column 8, line 40, add a --,-- after the word "rod".

Signed and Sealed this
First Day of February, 2000

*Attest:*

*Attesting Officer*

Q. TODD DICKINSON

*Acting Commissioner of Patents and Trademarks*